US009718037B2

(12) United States Patent
Harmon et al.

(10) Patent No.: US 9,718,037 B2
(45) Date of Patent: Aug. 1, 2017

(54) MIXING SYSTEM FOR AFTERTREATMENT SYSTEM

(71) Applicant: Caterpillar Inc., Peoria, IL (US)

(72) Inventors: Aaron Harmon, Dunlap, IL (US); Andrew M. Denis, Peoria, IL (US); Anthony C. Rodman, Peoria, IL (US); Eric P. Spaeth, Pekin, IL (US); Jayaraman K. Venkataraghavan, Dunlap, IL (US); Raymond U. Isada, Peoria, IL (US); Yong Yi, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 148 days.

(21) Appl. No.: 14/573,581

(22) Filed: Dec. 17, 2014

(65) Prior Publication Data

US 2016/0175784 A1 Jun. 23, 2016

(51) Int. Cl.

| | |
|---|---|
| ***B01F 3/04*** | (2006.01) |
| ***B01F 5/06*** | (2006.01) |
| ***B01F 5/04*** | (2006.01) |

(52) U.S. Cl.

CPC ..... *B01F 5/0473* (2013.01); *B01F 3/04049* (2013.01); *B01F 5/0617* (2013.01); *B01F 2005/0639* (2013.01)

(58) Field of Classification Search

CPC .. B01F 5/0473; B01F 5/0616; B01F 3/04049; B01F 5/0617; B01F 2005/0639

USPC ..... 366/336–340, 174.1–175.2

See application file for complete search history.

(56) References Cited

U.S. PATENT DOCUMENTS

| | | | | | |
|---|---|---|---|---|---|
| 1,637,697 | A | * | 8/1927 | Jacobsen | B01F 5/0644 137/599.12 |
| 2,312,639 | A | * | 3/1943 | Gronemeyer | B01F 3/0873 138/40 |
| 2,669,946 | A | * | 2/1954 | Peyton | A23G 9/282 366/173.2 |
| 3,190,618 | A | * | 6/1965 | Katzen | B01F 5/0619 366/337 |
| 3,297,305 | A | * | 1/1967 | Walden | B01F 5/0451 169/15 |
| 3,550,912 | A | * | 12/1970 | Djumulen | B01F 3/0807 366/339 |
| 3,582,048 | A | * | 6/1971 | Sarem | B01F 5/0644 138/38 |

(Continued)

FOREIGN PATENT DOCUMENTS

| | | | |
|---|---|---|---|
| CN | 202900380 U | * | 5/2015 |
| DE | 102011120221 | | 6/2013 |

(Continued)

*Primary Examiner* — Tony G Soohoo

(74) *Attorney, Agent, or Firm* — Mattingly Burke Cohen & Biederman LLP

(57) ABSTRACT

A mixing system for an aftertreatment system is disclosed. The mixing system includes a mixing tube. The mixing tube is provided in fluid communication with an exhaust conduit. The mixing system also includes a reductant injector positioned at an injection location on the mixing tube. The mixing system further includes a mixer assembly positioned downstream of the injection location. The mixer assembly includes a plurality of mixing elements provided in a series arrangement, such that each of the plurality of mixing elements is provided downstream of one another.

12 Claims, 10 Drawing Sheets

(56) References Cited

U.S. PATENT DOCUMENTS 3,583,678 A * 6/1971 Harder ..... B01F 5/0644 366/340
3,779,518 A * 12/1973 Koepke ..... B01F 5/0646 137/565.33
3,861,652 A * 1/1975 Clark ..... B01F 5/0612 366/336
3,880,597 A * 4/1975 Goldschmidt ..... B01D 47/06 261/115
3,928,199 A * 12/1975 Kirk ..... B01F 3/0446 210/150
4,068,830 A * 1/1978 Gray ..... B01F 5/0451 366/175.2
4,266,879 A * 5/1981 McFall ..... B01F 11/0208 366/108
4,641,705 A * 2/1987 Gorman ..... F28F 13/125 165/109.1
4,674,888 A * 6/1987 Carlson ..... B01F 3/04262 162/57
4,824,614 A * 4/1989 Jones ..... B01F 5/0617 137/561 A
4,929,088 A * 5/1990 Smith ..... B01F 5/0473 138/40
4,981,368 A * 1/1991 Smith ..... B01F 5/0473 366/337
5,333,952 A * 8/1994 Perdue ..... B01F 5/0659 366/336
5,380,088 A * 1/1995 Fleischli ..... B01F 5/0618 261/112.2
5,407,274 A * 4/1995 Woerheide ..... B01F 5/0617 137/561 A
5,709,468 A * 1/1998 Woerheide ..... B01F 5/064 137/1
6,074,619 A 6/2000 Schoubye
6,086,241 A * 7/2000 Herr ..... B01F 5/0451 366/181.5
6,279,611 B2 * 8/2001 Uematsu ..... B01F 5/00 137/888
6,516,610 B2 2/2003 Hodgson
6,722,123 B2 4/2004 Liu et al.
7,547,134 B2 * 6/2009 Hansen ..... B01F 5/0451 366/175.2
7,581,387 B2 9/2009 Bui et al.
7,814,745 B2 10/2010 Levin et al.
8,082,732 B2 12/2011 Nefischer
8,136,980 B2 * 3/2012 Smith ..... F15D 1/001 366/337
8,272,777 B2 9/2012 Kohrs et al.
8,359,832 B2 1/2013 Yi et al.
8,615,984 B2 12/2013 Kornherr et al.
8,635,858 B2 1/2014 Levin et al.
8,739,519 B2 6/2014 Hadden et al.
8,814,969 B2 8/2014 Nagasaka et al.
9,010,994 B2 * 4/2015 McQueen ..... B01F 5/0618 366/337
9,095,827 B2 * 8/2015 Sampath ..... B01F 5/0473
2007/0036694 A1 2/2007 Nishioka et al.
2008/0066448 A1 * 3/2008 Halbei ..... F01N 3/2066 60/282
2008/0134671 A1 * 6/2008 Nefischer ..... B01D 53/90 60/300
2008/0295497 A1 * 12/2008 Kornherr ..... B01D 53/90 60/286
2009/0266064 A1 * 10/2009 Zheng ..... B01F 3/04049 60/317
2010/0107617 A1 * 5/2010 Kaiser ..... B01F 3/04049 60/324
2011/0067381 A1 3/2011 Zimmerman et al.
2012/0224998 A1 9/2012 Lee et al.
2013/0170973 A1 7/2013 Staskowiak et al.
2013/0188440 A1 * 7/2013 Tabikh ..... B01F 3/02 366/174.1
2013/0239546 A1 9/2013 Levin et al.
2013/0247545 A1 9/2013 Solbrig et al.
2013/0330242 A1 12/2013 Manickam et al.
2013/0333363 A1 12/2013 Joshi et al.
2014/0090374 A1 * 4/2014 Chavannavar ..... F01N 3/0814 60/605.2
2014/0178264 A1 6/2014 Floyd et al.
2014/0366514 A1 * 12/2014 Lewis ..... F01N 3/2066 60/297
2015/0233276 A1 * 8/2015 Cassity ..... F01N 3/2885 422/176

FOREIGN PATENT DOCUMENTS

DE 11 2012 006 957 T5 * 6/2015
EP 1712756 10/2006
EP 2687697 1/2014
EP 2732869 * 5/2014
JP 2008- 274852 A * 3/2017
WO 2011053013 5/2011
WO 2011135161 11/2011
WO 2013099404 7/2013
WO 2014025538 2/2014
WO WO 2014051617 * 4/2014

* cited by examiner

MIXING SYSTEM FOR AFTERTREATMENT SYSTEM

TECHNICAL FIELD

The present disclosure relates to a mixing system, more specifically to a mixing system for an aftertreatment system.

BACKGROUND

An aftertreatment system is associated with an engine system. The aftertreatment system is configured to treat and reduce oxides of nitrogen (NOx) present in an exhaust gas flow, prior to the exhaust gas flow exiting into the atmosphere. In order to reduce NOx, the aftertreatment system may include a reductant delivery module, a reductant injector, and a Selective Catalytic Reduction (SCR) module.

The reductant injector is configured to inject a reductant into the exhaust gas flowing through a mixing tube of the aftertreatment system. In order to achieve improved levels of NOx conversion, better flow distribution and mixing of the reductant with the exhaust gases must be achieved. A mixing element is affixed inside the mixing tube so that increased turbulence and improved distribution of the reductant within the exhaust gases may be achieved within a short length of the mixing tube.

However, sometimes the mixing element may provide a surface for the reductant particles to collect thereon, leading to formation of solid deposits. Deposit formation may in turn lead to increased back pressure on the engine and reduce an overall effectiveness of the mixing element. Further, the functioning of the aftertreatment system may be affected as well, causing a reduction in NOx conversion capability and increase in ammonia slip.

U.S. Pat. No. 8,272,777 describes a method for mixing an exhaust gas flow with a fluid in an exhaust gas pipe of an exhaust gas system, in which the fluid is injected by means of an injection device into the exhaust gas pipe. The exhaust gas flow is guided in the exhaust gas pipe in the area of the injection device in a direction of flow parallel to the exhaust gas pipe. The fluid is injected directly onto a deflection element which is arranged in the exhaust gas pipe in a central direction of injection which deviates from the direction of flow by an angle, wherein by means of at least one sheet metal part which is provided on the deflection element and which is raised at least partially at an angle with reference to the direction of flow, the exhaust gas flow is diverted with reference to the direction of flow from its direction of flow into a central direction of distribution.

SUMMARY OF THE DISCLOSURE

In one embodiment of the present disclosure, a mixing system for an aftertreatment system is disclosed. The mixing system includes a mixing tube. The mixing tube is provided in fluid communication with an exhaust conduit. The mixing system also includes a reductant injector positioned at an injection location on the mixing tube. The mixing system further includes a mixer assembly positioned downstream of the injection location. The mixer assembly includes a plurality of mixing elements provided in a series arrangement, such that each of the plurality of mixing elements is provided downstream of one another.

Other features and aspects of this disclosure will be apparent from the following description and the accompanying drawings.

DETAILED DESCRIPTION

Figure 1:
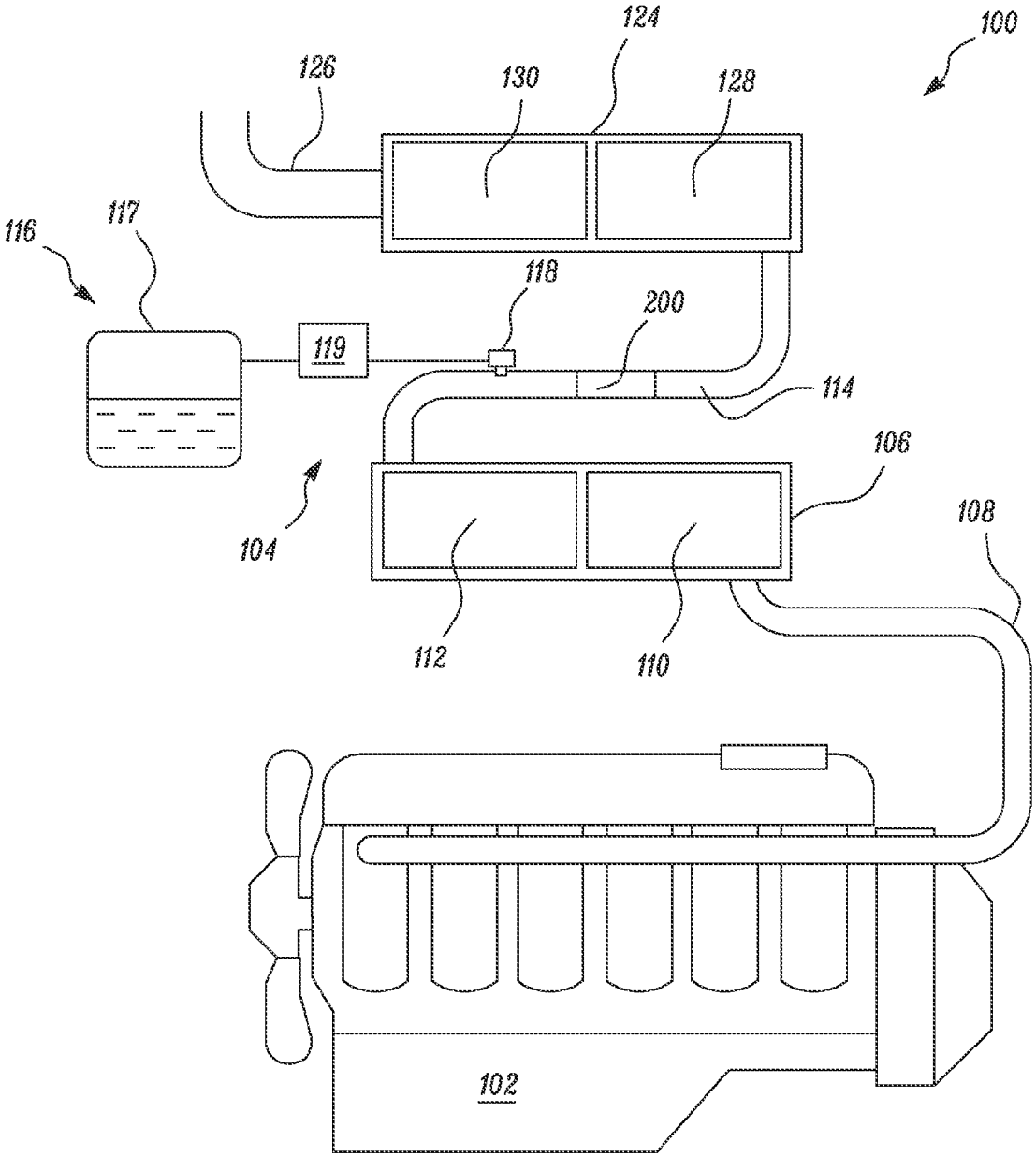
FIG. 1 is a schematic diagram of an exemplary engine system having an aftertreatment system associated therewithin, according to an embodiment of the disclosure.

Wherever possible, the same reference numbers will be used throughout the drawings to refer to the same or the like parts. Referring to FIG. 1, a schematic diagram of an exemplary engine system 100 is illustrated, according to one embodiment of the present disclosure. The engine system 100 includes an engine 102, which may be an internal combustion engine, such as, a reciprocating piston engine or a gas turbine engine. The engine 102 is a spark ignition engine or a compression ignition engine, such as, a diesel engine, a homogeneous charge compression ignition engine, or a reactivity controlled compression ignition engine, or other compression ignition engines known in the art. The engine 102 may be fueled by gasoline, diesel fuel, biodiesel, dimethyl ether, alcohol, natural gas, propane, hydrogen, combinations thereof, or any other combustion fuel known in the art.

The engine 102 may include other components (not shown), such as, a fuel system, an intake system, a drivetrain including a transmission system, and so on. The engine 102 may be used to provide power to any machine including, but not limited to, an on-highway truck, an off-highway truck, an earth moving machine, an electric generator, and so on. Accordingly, the engine system 100 may be associated with an industry including, but not limited to, transportation, construction, agriculture, forestry, power generation, and material handling.

Referring to FIG. 1, the engine system 100 includes an aftertreatment system 104 fluidly connected to an exhaust manifold of the engine 102. The aftertreatment system 104 is configured to treat an exhaust gas flow exiting the exhaust manifold of the engine 102. The exhaust gas flow contains emission compounds that may include oxides of nitrogen (NOx), unburned hydrocarbons, particulate matter, and/or other combustion products known in the art. The aftertreatment system 104 may be configured to trap or convert NOx, unburned hydrocarbons, particulate matter, combinations thereof, or other combustion products present in the exhaust gas flow, before exiting the engine system 100.

In the illustrated embodiment, the aftertreatment system 104 includes a first module 106 that is fluidly connected to an exhaust conduit 108 of the engine 102. During engine operation, the first module 106 is arranged to internally receive engine exhaust gas from the exhaust conduit 108. The first module 106 may contain various exhaust gas treatment devices, such as, a Diesel Oxidation Catalyst (DOC) 110 and a Diesel Particulate Filter (DPF) 112, but other devices may be used. The first module 106 and the components found therein are optional and may be omitted for various engine applications in which the exhaust treatment function provided by the first module 106 is not required.

In the illustrated embodiment, the exhaust gas flow provided to the first module 106 by the engine 102 may first pass through the DOC 110 and then through the DPF 112 before entering a mixing tube 114. The aftertreatment system 104 includes a reductant supply system 116. A reductant is injected into the mixing tube 114 by a reductant injector 118. The reductant may be a fluid, such as, Diesel Exhaust Fluid (DEF). The reductant may include urea, ammonia, or other reducing agent known in the art.

Referring to FIG. 1, the reductant supply system 116 includes a reductant tank 117. The reductant is contained within the reductant tank 117. Parameters related to the reductant tank 117 such as size, shape, location, and material used may vary according to system design and requirements. Further, the reductant injector 118 may be communicably coupled to a controller (not shown). Based on control signals received from the controller, the reductant from the reductant tank 117 is provided to the reductant injector 118 by a pump assembly 119. As the reductant is injected into the mixing tube 114, the reductant mixes with the exhaust gas flow passing therethrough, and is carried to a second module 124. Further, the mixing tube 114 is configured to fluidly interconnect the first module 106 with the second module 124, such that, the exhaust gas flow from the engine 102 may pass through the first and second modules 106, 124 in series before being released at a stack 126 connected downstream of the second module 124. The mixing tube 114 defines a longitudinal axis A-A'. The second module 124 encloses a Selective Catalytic Reduction (SCR) module 128 and an Ammonia Oxidation Catalyst (AMOX) 130. The SCR module 128 operates to treat exhaust gases exiting the engine 102 in the presence of ammonia, which is provided after degradation of a urea-containing solution injected into the exhaust gases in the mixing tube 114. The AMOX 130 is used to convert any ammonia slip from the downstream flow of the SCR module 128 before exiting the stack 126.

Further, in order to promote mixing of the reductant with the exhaust gas flow, a mixing system 200 may be associated with the aftertreatment system 104. The mixing system 200 is provided within a portion of the mixing tube 114. The amount of the reductant that may be injected into the mixing tube 114 may be appropriately metered based on engine operating conditions. The aftertreatment system 104 disclosed herein is provided as a non-limiting example. It will be appreciated that the aftertreatment system 104 may be disposed in various arrangements and/or combinations relative to the exhaust manifold. These and other variations in aftertreatment system design are possible without deviating from the scope of the disclosure. The mixing system 200 will now be explained in detail with reference to FIGS. 2-7.

Figure 2:
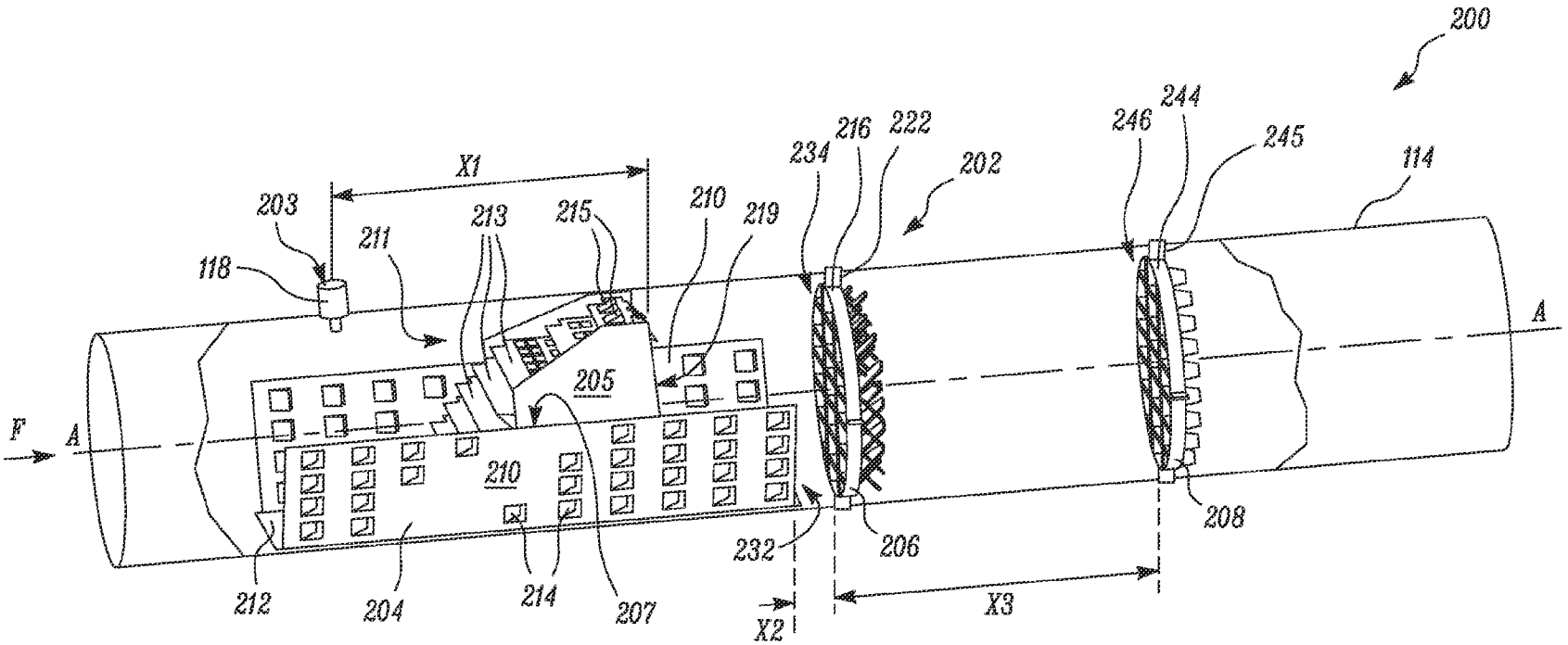
FIG. 2 is a break away perspective view of a portion of a mixing tube of the aftertreatment system of FIG. 1, according to an embodiment of the disclosure.

FIG. 2 illustrates a side perspective view of the portion of the mixing tube 114 having the mixing system 200 located therein, according to one embodiment of the present disclosure. The mixing system 200 includes a mixer assembly 202. The mixer assembly 202 is positioned downstream of an injection location 203 and upstream of the SCR module 128 (see FIG. 1). The term "injection location" used herein refers to a position on the mixing tube 114 at which the reductant injector 118 injects the reductant into the mixing tube 114. The mixer assembly 202 includes a plurality of mixing elements.

As shown in FIG. 2, the mixer assembly 202 includes three mixing elements, namely a first mixing element 204, a second mixing element 206, and a third mixing element 208. The mixing elements 204, 206, 208 are provided in a series arrangement, such that each of the mixing elements 204, 206, 208 is provided downstream of one another. The first, second, and third mixing elements 204, 206, 208 may be spaced apart from each other, such that distances "X1", "X2", "X3" respectively between consecutive mixing elements 204, 206, 208 may vary along an exhaust gas flow direction shown by arrow "F". Each of the first, second, and third mixing elements 204, 206, 208 are configured to assist in achieving improved mixing of the reductant with the exhaust gas flow on passage of the exhaust gas and the reductant therethrough.

It should be noted that the reductant injected in to the exhaust gas flow is generally in a liquid state. The each of the mixing elements 204, 206, 208 of the mixing system 200 is configured to break up and evaporate the reductant injected into the exhaust gas flow, such that before entering the SCR module 128, the reductant is in a gaseous state and is homogenously mixed with the exhaust gas flow.

Figure 3:
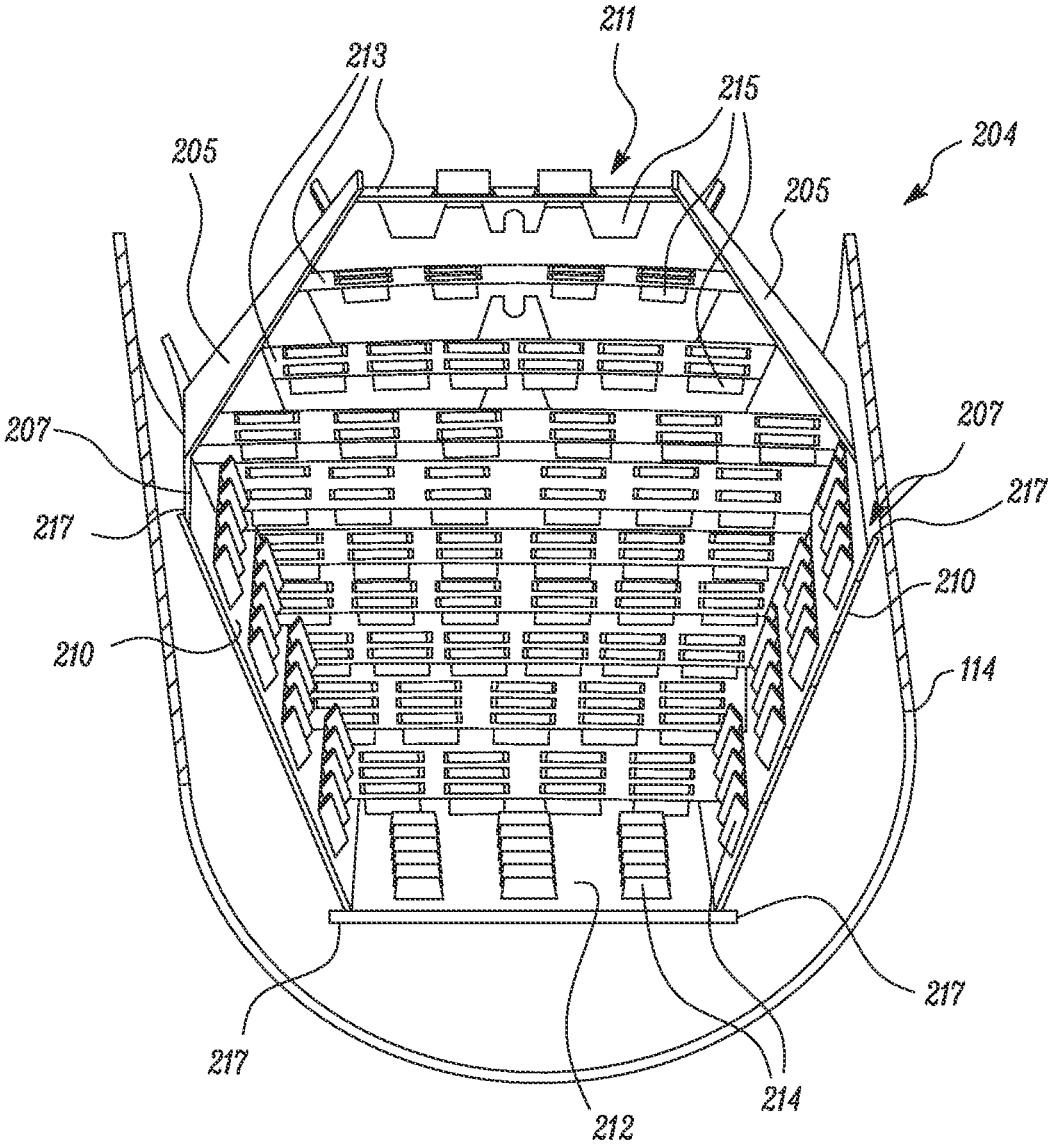
FIGS. 3, 4, and 5 are perspective views of individual mixing elements associated with a mixing assembly of FIG. 2, according to some embodiments of the present disclosure.

The first mixing element 204 of the mixer assembly 202 is different from the second mixing element 206. Referring to FIGS. 2 and 3, the first mixing element 204 is a primary mixing element, and is embodied as a flow convergent and impingement mixer. The first mixing element 204 includes a first pair of sidewalls 210 and a bottom wall 212. The first pair of sidewalls 210 extends vertically upwards from the bottom wall 212. Each of the first pair of sidewalls 210 and the bottom wall 212 of the first mixing element 204 includes a plurality of tabs 214 provided thereon. The tabs 214 open towards an inner side of the first mixing element 204. The first mixing element 204 also includes a second pair of sidewalls 205. The second pair of sidewalls 205 extending vertically upwards from an upper edge 207 of the first pair of sidewalls 210.

FIG. 3 illustrates a front perspective view of the first mixing element 204. The first mixing element 204 also includes a shelf arrangement 211 having a number of shelves 213. The shelves 213 are arranged horizontally within the first mixing element 204. Also, each of the shelves 213 is parallel to each other, and is also parallel to the bottom wall 212. Some of the shelves 213 are mounted such that they extend between and are coupled to the first pair of sidewalls 210. Whereas, remaining of the shelves 213 extend between and are coupled the second pair of sidewalls 205. Further, each of the shelves 213 include a plurality of tabs 215 provided thereon. Based on system requirements, the tabs 215 may either extend upwards or downwards with reference to a surface of the shelves 213.

The first mixing element 204 also includes a plurality of attachment tabs 217. The attachment tabs 217 may be provided at different positions on the first mixing element 204 in order to mount the first mixing element 204 within the mixing tube 114. It should be noted that a number of shelves 213, number and orientation of the tabs 215, and the number of attachment tabs 217 may vary based on system requirements.

Referring now to FIG. 2, the first mixing element 204 is provided at the optimum distance "X1" from the injection location 203, such that the reductant may contact the tabs 214, 215 of the first mixing element 204 when injected into the exhaust gas flow. The distance "X1" disclosed herein is defined as the distance between the injection location 203 and a downstream edge 219 of the shelf arrangement 211. In one example, the distance "X1" may approximately lie between 10 to 13 inches or 13 to 15 inches. For example, the distance "X1" may be approximately equal to 14 inches.

Figure 4:
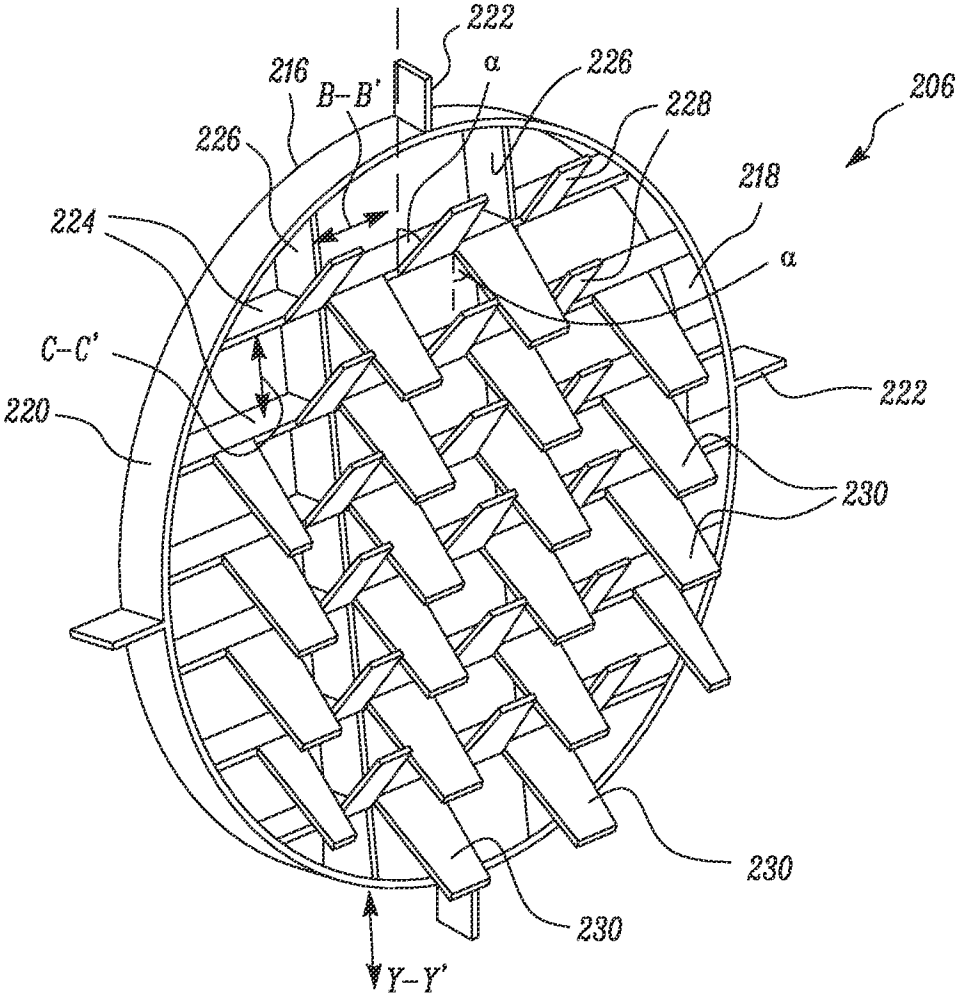

Referring now to FIGS. 2 and 4, the mixer assembly 202 includes the second mixing element 206. The second mixing element 206 is embodied as a flapper mixer. The second mixing element 206 is configured to mix the reductant and the exhaust gas flow in an up to down manner. Referring to FIG. 4, the second mixing element 206 includes a ring-shaped wall 216 having an inner surface 218 and an outer surface 220. The outer surface 220 of the wall 216 is provided with a plurality of projections 222. The projections 222 assist in mounting the second mixing element 206 within the mixing tube 114 (as shown in FIG. 2). In the illustrated embodiment, four projections 222 extend from the outer surface 220 of the wall 216. It should be noted that the number of projections 222 may vary based on system requirements.

The second mixing element 206 includes a plurality of first support members 224. The first support members 224 extend along a first direction B-B'. In this example, the first support members 224 are attached between inner surfaces 218 of the wall 216 of the second mixing element 206. Further, each of the plurality of first support members 224 is parallel to each other. The second mixing element 206 also includes second support members 226. The second mixing element 206 disclosed herein includes a pair of second support members 226, however the number of second support members 226 may vary as per operational requirements. The second support members 226 extend along a second direction C-C', such that the second direction C-C' is perpendicular to the first direction B-B'. The second support members 226 are also attached between the inner surfaces 218 of the wall 216 of the second mixing element 206, and are parallel to each other.

The second mixing element 206 further includes a first set of fin elements 228 and a second set of fin elements 230. The fin elements 228, 230 have a trapezoidal shape. Alternatively, the fin elements 228, 230 may have any other shape known in the art that serves the purpose of mixing. The fin elements 228, 230 are attached to and extend from the first support members 224 of the second mixing element 206. Further, each of the fin elements 228, 230 are attached to the first support members 224 in an angled manner. An inclination of the fin elements 228, 230 with respect to a vertical axis Y-Y' of the second mixing element 206 is defined as a fin angle "α". Further, in the illustrated embodiment, the fin elements 228, 230 make an acute angle with respect to the axis Y-Y'. More specifically, the first set of fin elements 228 has the fin angle "α", such that the fin elements 228 extend upwards from the first support members 224. Whereas the second set of fin elements 230 have the fin angle "α", such that the fin elements 230 extend downwards from the first support members 224. In one example, the fin angle "α" may approximately lay between ±1° to 60°. However, the value of the fin angle "α" is not limited thereto, and may vary based on system requirements. It should be noted that the number of fin elements 228, 230 attached to the second mixing element 206 may also vary based upon a desired fin density. The term "fin density" used herein is calculated based upon the number of fin elements provided per unit area of a particular mixing element.

As shown in FIG. 2, the second mixing element 206 is provided downstream of the first mixing element 204 at a location such that the reductant may contact the fin elements 228, 230 of the second mixing element 206. Accordingly, the second mixing element 206 is provided at the optimum distance "X2" from a downstream edge 232 of the first mixing element 204. The distance "X2" is defined as the distance between the downstream edge 232 of the first mixing element 204 and an upstream edge 234 of the second mixing element 206. In one embodiment, the distance "X2" may approximately lie between 0.5 to 2.5 inches or 2.5 to 5 inches. For example, the distance "X2" may be approximately equal to 2 inches.

Figure 5:
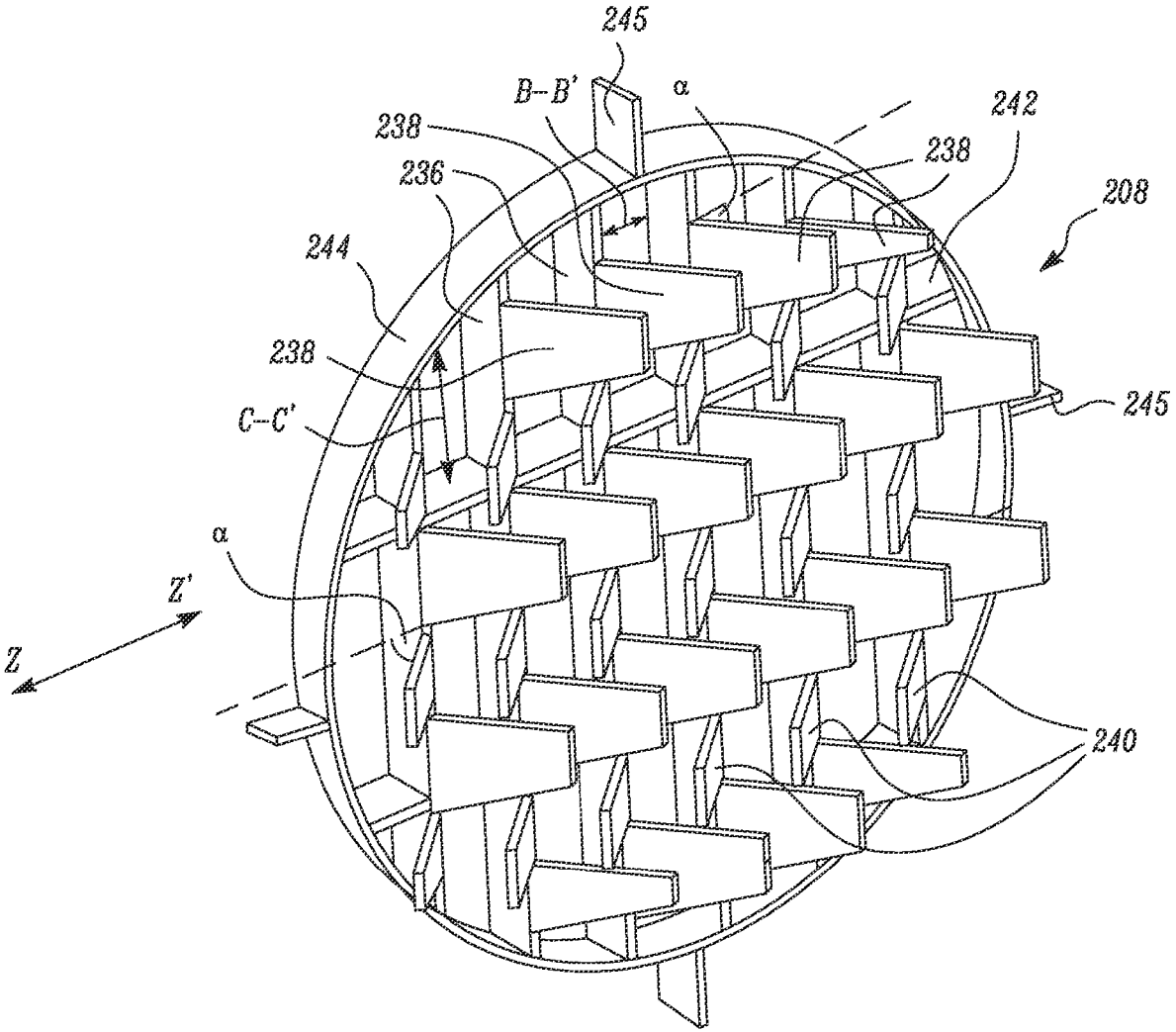

Referring now to FIGS. 2 and 5, the mixer assembly 202 includes the third mixing element 208. The third mixing element 208 is mounted downstream of the second mixing element 206, along the exhaust gas flow direction "F" (see FIG. 2). The third mixing element 208 is configured to mix the reductant with the exhaust gas flow in a horizontal or side to side manner. The third mixing element 208 may be embodied as a flapper mixer, and has constructional features similar to the second mixing element 206 that is explained earlier in this section. As shown in FIG. 2, the third mixing element 208 is mounted in a different orientation as compared to that of the second mixing element 206 within the mixing tube 114. The third mixing element 208 is clocked by an angle of 90° with respect to the longitudinal axis A-A' of the mixing tube 114. The term "clocking" used herein is defined as an angular orientation of the mixing element with respect to an attachment of the mixing element with respect to the mixing tube 114.

Referring to FIG. 5, the clocking of the third mixing element 208 by 90° with respect to the longitudinal axis A-A' causes a first support members 236 of the third mixing element 208 to extend vertically along the second direction C-C', as against the first support members 224 of the second mixing element 206 which extend horizontally along the first direction B-B' (see FIG. 4). Also, the third mixing element 208 includes first and second set of fin elements 238, 240 that extend from the first support members 236, and are attached thereto. The first set of fin elements 238 and the second set of fin elements 240 are angled with respect to an axis Z-Z'. Further, second support members 242 of the third mixing element 208 extend along the first direction B-B'. The third mixing element 208 also includes projections 245 for mounting the third mixing element 208 within the mixing tube 114.

Further, in an exemplary embodiment, the fin density of the third mixing element 208 may be higher as compared to the fin density of the second mixing element 206, such that the third mixing element 208 includes higher number of fin elements 238, 240 compared to the number of fin elements 228, 230 of the second mixing element 206. In some embodiments, the fin angle "α" of the fin elements 228, 230, 238, 240 of each of the second and third mixing elements 206, 208 may also vary. In one example, the fin angle "α" of the fin elements 238, 240 of the third mixing element 208 may be lesser than the fin angle "α" of the fin elements 228, 230 of the second mixing element 206 (see FIGS. 4 and 5).

For better mixing and stratification of the reductant with the exhaust gas flow, the third mixing element 208 is provided at an optimum location within the mixing tube 114, so that the reductant may contact the fin elements 238, 240 of the third mixing element 208, instead of a wall 244 of the third mixing element 208. Accordingly, the third mixing element 208 is provided in the mixing tube 114 at the distance "X3" (see FIG. 2) from the second mixing element 206. More particularly, the distance "X3" is defined as the distance between the upstream edge 234 of the second mixing element 206 and an upstream edge 246 of the third mixing element 208. In one embodiment, the distance "X3" may approximately lie between 5 to 7 inches or 7 to 10 inches. For example the distance "X3" may be approximately equal to 8 inches. In an exemplary embodiment, the mixing assembly 202 may also include a pre-mixer (not shown). The pre-mixer may be positioned upstream of the first mixing element 204, and may be configured to impart slight turbulence to the exhaust gas flow entering the mixing tube 114.

Figure 6:
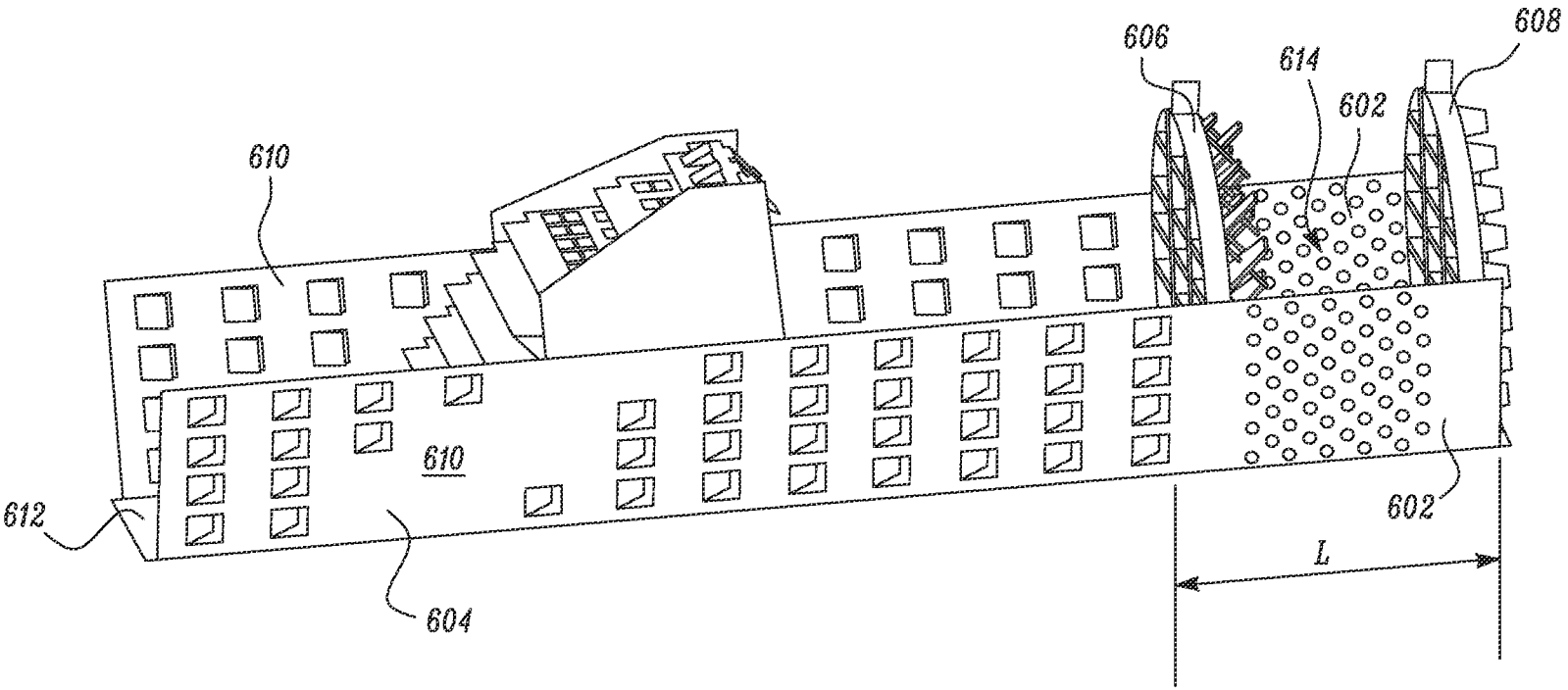
FIGS. 6 and 7 are perspective views of a first mixing element, according to some embodiments of the present disclosure.
Figure 7:
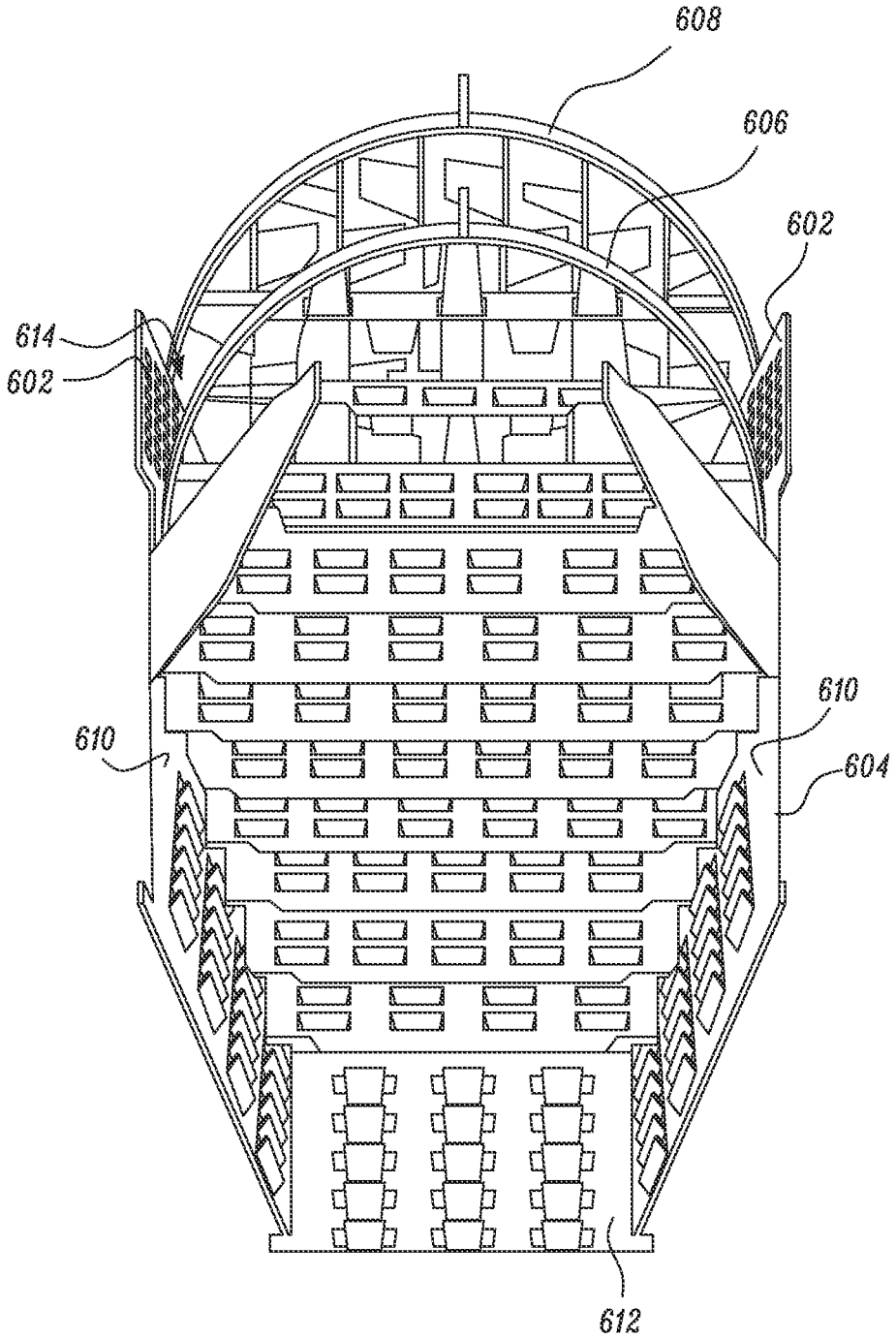

In an alternate embodiment of the present disclosure, as shown in FIGS. 6 and 7, an attachment surface 602 is associated with a first mixing element 604, a second mixing element 606, and a third mixing element 608. The attachment surface 602 is configured to couple the first mixing element 604, the second mixing element 606, and the third mixing element 608 with each other. Design features of the first mixing element 604, the second mixing element 606, and the third mixing element 608 are similar to the design features of the first, second, and third mixing elements 204, 206, 208 explained earlier with reference to FIGS. 2 to 5. As shown in FIGS. 6 and 7, the attachment surfaces 602 may be three in number, and are formed by extending a first pair of sidewalls 610 and a bottom wall 612 of the first mixing element 604. The attachment surfaces 602 are provided such that a space 614 so formed and enclosed by each of the attachment surfaces 602 is configured to receive the second and third mixing elements 606, 608 therein. Further, a length "L" of the attachment surfaces 602 may vary based on the mounting position of the second and third mixing elements 606, 608.

Alternatively, the attachment surface 602 may be shaped as a bar member. One or more such bar members may be associated with the mixing elements 604, 606, 608 in order to couple the mixing elements 604, 606, 608 with each other. Further, in another embodiment, the attachment surfaces 602 may be embodied by extending only the first pair of sidewalls 610 of the first mixing element 604, and not the bottom wall 612 of the first mixing element 604.

Figure 8:
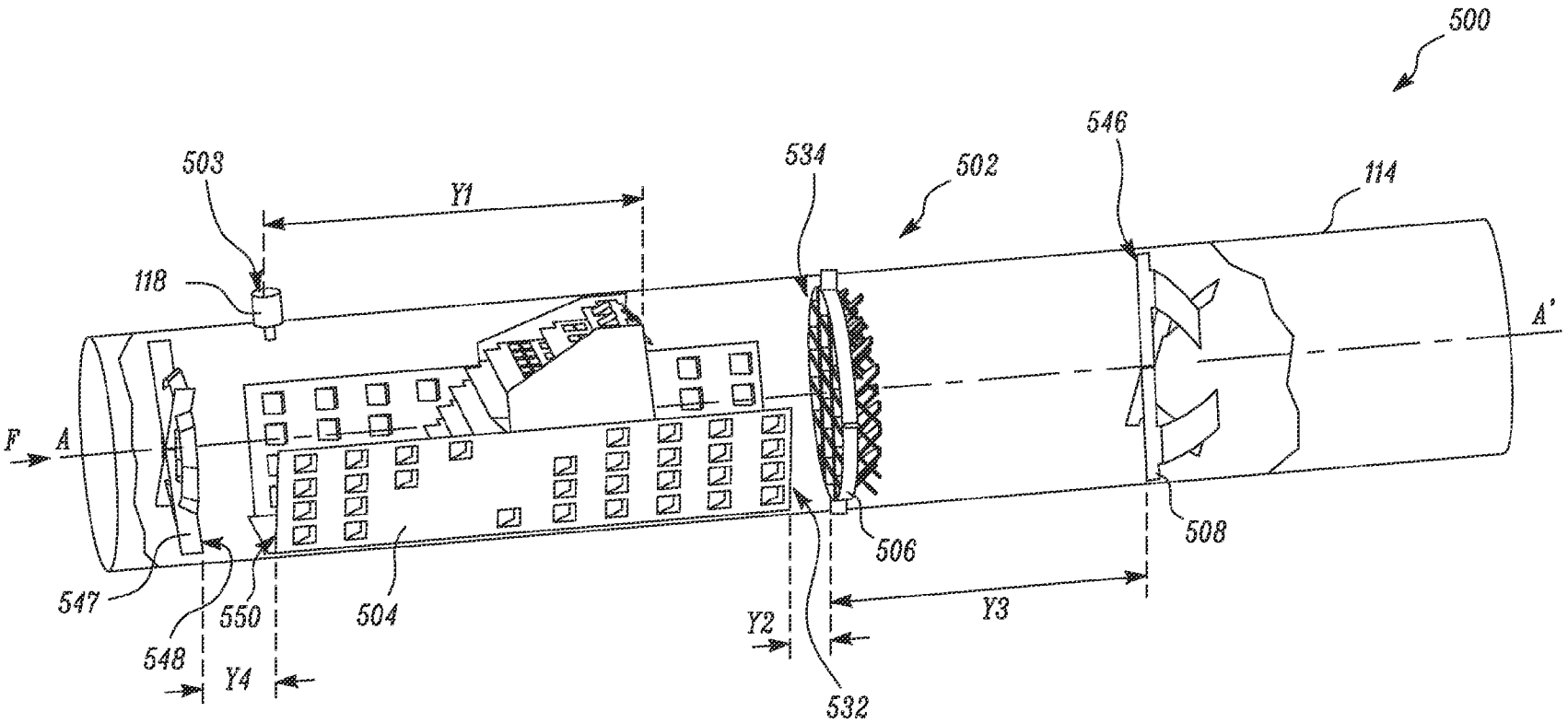
FIG. 8 is a break away perspective view of a portion of the mixing tube of FIG. 1 having another mixing assembly, according to other embodiments of the disclosure.

FIG. 8 illustrates another embodiment of the present disclosure in which each of the mixing elements is different from each other. In this embodiment, a mixer assembly 502 of a mixing system 500 includes first and second mixing elements 504, 506 having constructional features similar to that of the first and second mixing elements 204, 206 illustrated and explained with reference to FIGS. 2 to 4. Also, the first mixing element 504 is provided at a distance "Y1" from an injection location 503. The distance "Y1" may lie approximately between 10 to 12 inches or 12 to 15 inches. In one example the distance "Y1" may be approximately equal to 11.5 inches. Further, the second mixing element 506 is mounted at a distance "Y2". The distance "Y2" is defined as the distance between a downstream edge 532 of the first mixing element 504 and an upstream edge 534 of the second mixing element 506. The distance "Y2" may lie approximately between 1 to 2.5 inches or 2.5 to 5 inches. In one example, the distance "Y2" may be approximately equal to 4 inches.

In addition to the first and second mixing elements 504, 506, the mixer assembly 502 may include a pre-mixer 547. The pre-mixer 547 is embodied as a booster. The pre-mixer 547 is configured to impart a slight turbulence to the exhaust gas flow entering the mixing tube 114, before the reductant is injected therein. The pre-mixer 547 is provided at a distance "Y4" from the first mixing element 504. More particularly, the distance "Y4" may be defined as the distance between a downstream edge 548 of the pre-mixer 547 and an upstream edge 550 of the first mixing element 504. The distance "Y4" may lie approximately between 1 to 2 inches or 2 to 4 inches. In one example, the distance "Y4" may be approximately equal to 3 inches.

Figure 9:
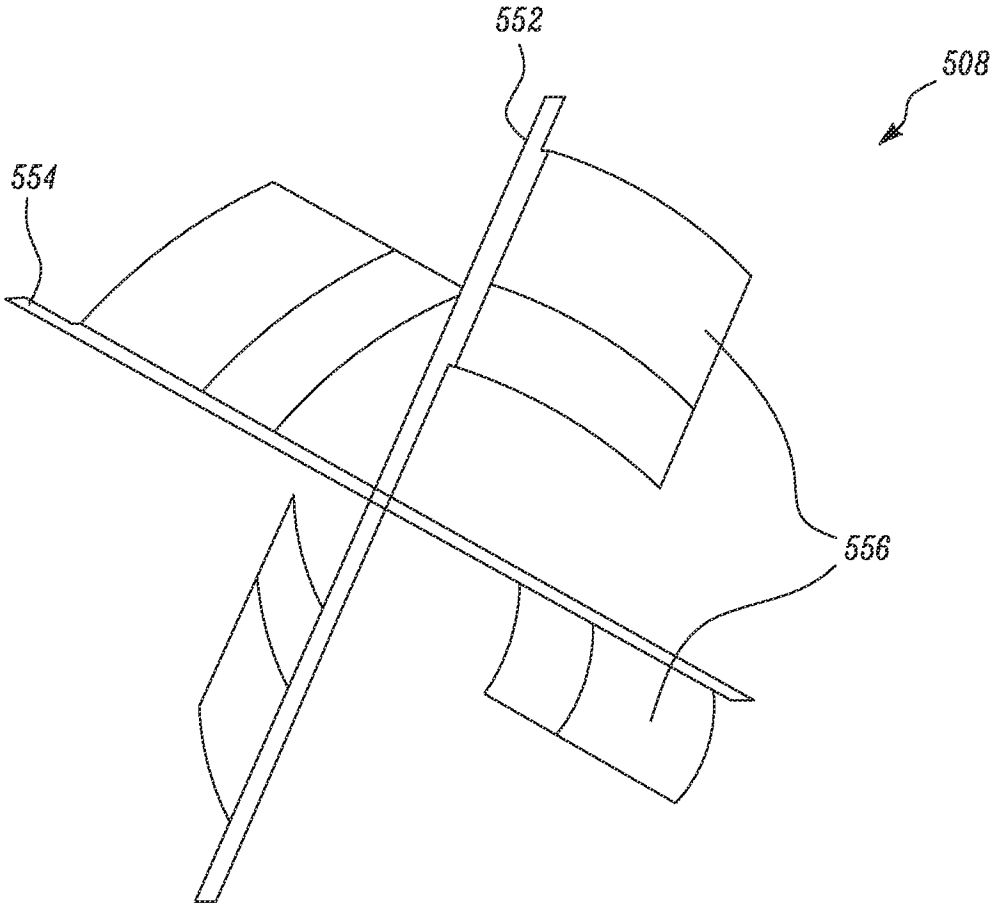
FIG. 9 is a perspective view of a mixing element associated with the mixing assembly of FIG. 8.

Referring now to FIGS. 8 and 9, the mixer assembly 502 includes a third mixing element 508. In this embodiment, the third mixing element 508 is embodied as a swirl mixer. As shown in FIG. 9, the third mixing element 508 includes a first bar member 552 and a second bar member 554. The first and second bar members 552, 554 are connected in a scissor-type arrangement. Each end of the first and second bar members 552, 554 includes blades 556 attached thereto. In the illustrated embodiment, the third mixing element 508 includes four such blades 556; however, based on system requirements, the third mixing element 508 may include more than four blades 556. Also, an angle of attachment of the blades 556 with the bar members 552, 554 may vary in order to achieve optimum mixing of the reductant with the exhaust gas flow. It should be further noted that for better mixing of the reductant with the exhaust gas flow, the third mixing element 508 may be clocked differently from that shown in the accompanying figures.

As shown in FIG. 8, the third mixing element 508 is mounted within the mixing tube 114 so as to achieve evaporation of the reductant and also to provide close to uniform mixing of the reductant with the exhaust gas flow. The third mixing element 508 is provided at a distance "Y3" from the second mixing element 506. More particularly, the distance "Y3" is defined as the distance between an upstream edge 534 of the second mixing element 506 and an upstream edge 546 of the third mixing element 508. The distance "Y3" may lie approximately between 10 to 15 inches or 15 to 25 inches. In one embodiment, the distance "Y3" may be approximately equal to 15 inches.

Figure 10:
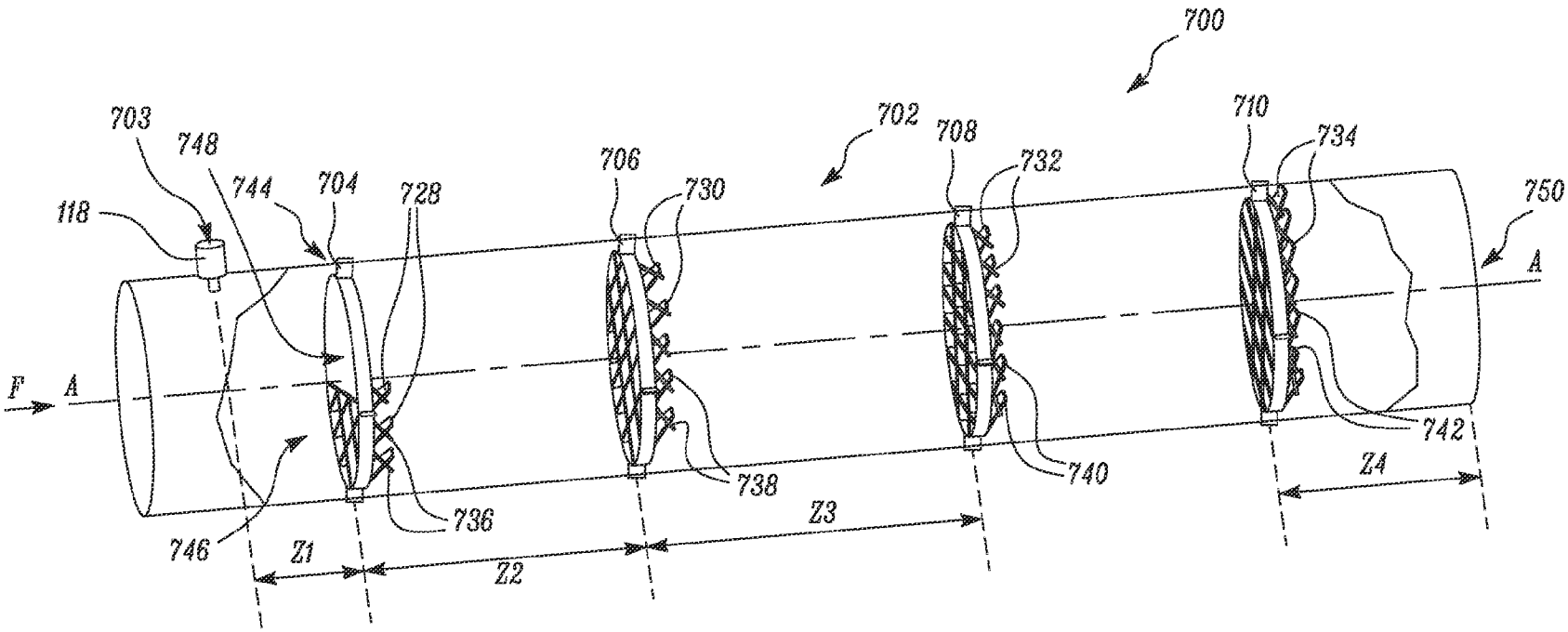
FIG. 10 is a break away perspective view of a portion of the mixing tube of FIG. 1 having yet another mixing assembly, according to some other embodiments of the disclosure.

FIG. 10 illustrates yet another embodiment of the present disclosure. A mixer assembly 702 of a mixing system 700 includes four mixing elements, namely a first mixing element 704, a second mixing element 706, a third mixing element 708, and a fourth mixing element 710. The mixing elements 704, 706, 708, 710 are provided downstream of an injection location 703. Further, the mixing elements 704, 706, 708, 710 are provided in a series arrangement, downstream of one another. Each of the mixing elements 704, 706, 708, 710 is of the same type, and is embodied as a flapper mixer. The constructional features of the mixing elements 704, 706, 708, 710 are similar to the constructional features of the flapper mixer explained earlier in this section. Accordingly, each of the mixing elements 704, 706, 708, 710 respectively include a first set of fin elements 728, 730, 732, 734, and a second set of fin elements 736, 738, 740, 742 respectively.

However, it should be noted that each of the mixing elements 704, 706, 708, 710 are designed such that at least one parameter of the mixing elements 704, 706, 708, 710 may change or be adjusted along the exhaust gas flow direction "F". The parameter may include the fin density, the fin angle "α", the clocking of the mixing elements 704, 706, 708, 710 with respect to each other, or any combination of the parameters. The first mixing element 704 of the mixer assembly 702 is mounted within the mixing tube 114 at a distance "Z1" from the injection location 703, so that the first mixing element 704 may capture reductant at low exhaust flow rates and may prevent the reductant from contacting a circular wall of the first mixing element 704.

As shown in the accompanying figures, the first mixing element 704 is divided into portions, namely a top portion 744 and a bottom portion 746. The top portion 744 of the first mixing element 704 is embodied as an open space 748. Further, the bottom portion 746 of the first mixing element 704 includes the fin elements 728, 736 attached thereto. The first mixing element 704 is configured to break up large particles of the reductant at low exhaust gas flow rates while flowing through the fin elements 728, 736. Whereas, the reductant may be allowed to pass through the open space 748 of the first mixing element 704 during high exhaust flow rates.

The fin elements 728, 736 of the first mixing element 704 have a shallow fin angle "α" as compared to the fin angle "α" of the remaining mixing elements 706, 708, 710 provided downstream of the first mixing element 704. The fin angle "α" is decided such that, the fin elements 728, 736 may promote a break up of large particles of the reductant and also promote mixing of the reductant with the exhaust gas flow. Further, the first mixing element 704 has relatively lower fin density as compared to fin densities of the remaining mixing elements 706, 708, 710.

The second mixing element 706 of the mixer assembly 702 is mounted within the mixing tube 114 at a distance "Z2" from the first mixing element 704. The distance "Z2" is decided such that the reductant particles, at high exhaust gas flow rates, hit the fin elements 730, 738 instead of the circular wall of the second mixing element 706. Further, the second mixing element 706 is configured to continue breaking of the reductant particles at low exhaust flow rates, and also to initiate the breaking of the large particles of the reductant at high exhaust flow rates. For this purpose, the second mixing element 706 is designed such that the fin elements 730, 738 have a shallow fin angle "α" at a top portion of the second mixing element 706. Also, the fin density of the second mixing element 706 may be lower at the top portion. In one embodiment, the fin density of the second mixing element 706 may be greater than the fin density of the first mixing element 704. The arrangement of the fin elements 730, 738 at the top portion of the second mixing element 706 may promote the breakup of the large particles of the reductant at high exhaust flow rates.

The fin angle "α" of the fin elements 730, 738 may progressively get steeper towards a bottom portion of the second mixing element 706. Also, the fin density of the second mixing element 706 may increase progressively towards the bottom portion of the second mixing element 706. This arrangement may allow for the continual breakup of the small particles of the reductant that may have already passed through the first mixing element 704 at low exhaust gas flow rates.

The third mixing element 708 is mounted within the mixing tube 114 at a distance "Z3" from the second mixing element 706. The distance "Z3" is optimized and decided such that minimal deposit formation may occur on the third mixing element 708 and close to uniform mixing of the reductant with the exhaust gas flow may be obtained. The third mixing element 708 is configured to break up the small particles of the reductant that may still exist in the exhaust gas flow and start a gaseous phase mixing of the reductant with the exhaust gas flow.

The third mixing element 708 includes the fin elements 732, 740. In the illustrated embodiment, the fin angle "α" of the fin elements 732, 740 is steeper at a top portion of the third mixing element 708, as compared to the fin angle "α" of the fin elements 730, 738 of the second mixing element 706. Further, the fin angle "α" may progressively get steeper towards a bottom portion of the third mixing element 708. Also, the fin density of the third mixing element 708 may be optimally chosen in order to reduce or minimize back pressure and promote uniform mixing of the reductant with the exhaust gas flow. The fin density may be constant from the top portion to the bottom portion of the third mixing element 708; however, the fin density of the third mixing element 708 may be higher as compared to the fin density of the second mixing element 706.

As shown in the accompanying figures, the third mixing element 708 is mounted within the mixing tube 114 at a different angular orientation within the mixing tube 114 as compared to the second mixing element 706. More particularly, the third mixing element 708 is clocked at a certain angle about the longitudinal axis A-A'. In some examples, the fin angle "α" of the fin elements 732, 740 may be optimized such that the third mixing element 708 may be clocked approximately up to 90° with respect to the second mixing element 706, about the longitudinal axis A-A'. The clocking of the third mixing element 708 may promote the gaseous phase mixing of the reductant with the exhaust gas flow.

The mixer assembly 702 includes the fourth mixing element 710. The fourth mixing element 710 may be configured to continue the breaking of the small particles of the reductant present in the exhaust gas flow, and may also promote gaseous mixing of the reductant with the exhaust gas flow. Further, the fourth mixing element 710 is mounted within the mixing tube 114 at a distance "Z4" from an outlet 750 of the mixing tube 114. The distance "Z4" may be optimally decided so as to achieve maximum evaporation of the reductant and also promote close to uniform mixing of the reductant with the exhaust gas flow.

Further, the fin angle "α" of the fin elements 734, 742 of the fourth mixing element 710 may be steeper as compared to the fin angle "α" of the fin elements 732, 740 of the third mixing element 708. The fin density of the fourth mixing element 710 may be optimized in order to minimize back-pressure and also to promote close to uniform mixing of the reductant with the exhaust gas flow. It should be noted that the fin density of the fourth mixing element 710 may be the highest as compared to the fin densities of the first, second, and third mixing elements 704, 706, 708. Further, the fin density of the fourth mixing element 710 may be uniform from a top portion to a bottom portion of the fourth mixing element 710. It should be further noted that the fin angle "α" of the fin elements 734, 742 may be optimized such that the fourth mixing element 710 may be clocked approximately up to 90° with respect to the third mixing element 708, about the longitudinal axis A-A'. The clocking of the fourth mixing element 710 may further promote the gaseous phase mixing of the reductant with the exhaust gas flow.

INDUSTRIAL APPLICABILITY

An optimum distribution of the reductant with the exhaust gas flow and the evaporation of the reductant in the mixing tube may be critical to the performance of the SCR module. Mixing systems are generally used for obtaining uniform flow distribution and thorough mixing of the reductant with the exhaust gas flow. However, an improper design of the mixing system may lead to increased formation of solid deposits of the reductant thereon. Deposit formation may lead to increased back pressure on the engine and reduce an effectiveness of the mixing system to blend the reductant with the exhaust gas flow, thereby leading to reduction in NOx conversion capability and increase in ammonia slip.

The present disclosure describes a low cost mixing system 200, 500, 700 which provides improved stratification of the reductant injected in the exhaust gas flow and also provides optimum mixing of the reductant with the exhaust gas flow in a multi-stage reductant break up arrangement. The mixing system 200, 500, 700 may be capable of achieving improved levels of NOx conversion through close to uniform distribution of the reductant with the exhaust gas flow, with minimal or no formation of solid deposits. The positioning of each of the mixing elements 204, 206, 208, 504, 506, 508, 547, 604, 606, 608, 704, 706, 708, 710 within the mixing systems 200, 500, 700 respectively may be optimized in order to achieve the higher levels of NOx conversion through close to uniform distribution of the reductant. The positioning of the mixing elements 204, 206, 208, 504, 506, 508, 547, 604, 606, 608, 704, 706, 708, 710 with respect to each other and/or the injection locations 203, 503, 703 respectively may also be adjusted as a function of an exhaust gas flow velocity and reductant particle diameter in order to control the residence time and evaporation rate of the reductant.

Also, it is possible to adjust the fin angle "α", fin density, and positioning of each of the mixing elements 204, 206, 208, 504, 506, 508, 547, 604, 606, 608, 704, 706, 708, 710 based on a function of a length of the mixing tube 114, in order to achieve optimum mixing of the reductant with the exhaust gas flow. Further, the process of designing the mixing systems 200, 500, 700 is simpler as compared to current designs because optimized mixing and distribution of the reductant with the exhaust gas flow may be achieved by breaking the function of uniform distribution into multiple mixing stages formed in each of the mixing assemblies 202, 502, 702.

Further, utilization of the multiple mixing elements 204, 206, 208, 504, 506, 508, 547, 604, 606, 608, 704, 706, 708, 710 may cause the engine system 100 to heat up faster as compared to the current designs. This may be beneficial from a reductant deposit formation perspective, especially when the engine system 100 is transitioning from a cold condition to a high temperature condition. A person of ordinary skill in the art will appreciate that mixing systems 200, 500, 700 of the present disclosure may be used across multiple platforms, apart from engine applications allowing for less development time and a consistent approach to mixing tube designs. The design may also allow for mixing of the reductant with the exhaust gas flow within shorter mixing tube lengths as compared to current designs.

While embodiments of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A mixing system for an aftertreatment system, the mixing system comprising:

a mixing tube in fluid communication with an exhaust conduit;

a reductant injector positioned at an injection location on the mixing tube; and a mixer assembly positioned downstream of the injection location, the mixer assembly including a plurality of mixing elements provided in a series arrangement;

the plurality of mixing elements further including a first mixing element having a shelf arrangement with a plurality of shelves arranged horizontally and parallel one another within the mixing tube, the plurality of shelves being located at a plurality of different shelf locations within a flow path of exhaust and reductant through the mixing tube such that a first one of the plurality of shelves is located upstream of a second one of the plurality of shelves;

the plurality of mixing elements further including a second mixing element at a second location that is downstream of the first mixing element to mix exhaust and reductant received from the first mixing element; and wherein the first mixing element is a flow convergent and impingement mixer comprising two sidewalls, each of the two sidewalls including a plurality of tabs provided thereon, and the second mixing element is one of a flapper mixer or a swirl mixer.

2. The mixing system of claim 1 further comprising a pre-mixer element positioned upstream of the injection location.

3. The mixing system of claim 1, wherein the plurality of mixing elements further includes a third mixing element, wherein the third mixing element is a flapper mixer.

4. The mixing system of claim 3, wherein at least one parameter of the third mixing element is different from that of the second mixing element, the at least one parameter including a fin density, a fin angle, an angle of attachment, a clocking of the flapper mixer about a longitudinal axis of the mixing tube, or a combination thereof.

5. The mixing system of claim 4, wherein at least one of the fin density or the fin angle increases from one mixing element to another along an exhaust flow direction.

6. The mixing system of claim 1, wherein the plurality of mixing elements further includes a third mixing element, wherein the third mixing element is a swirl mixer.

7. The mixing system of claim 1, wherein the plurality of mixing elements includes at least three mixing elements that are spaced apart such that a distance between each of the plurality of mixing elements increases along an exhaust flow direction.

8. The mixing system of claim 1, wherein the mixer assembly is positioned upstream of a selective catalytic reduction module.

9. A mixing system for an aftertreatment system, the mixing system comprising:

a mixing tube in fluid communication with an exhaust conduit;

a reductant injector positioned at an injection location on the mixing tube; and a mixer assembly positioned downstream of the injection location, the mixer assembly including a plurality of mixing elements provided in a series arrangement, such that each of the plurality of mixing elements is provided downstream of one another;

wherein the plurality of mixing elements includes a first mixing element and a second mixing element;

wherein the first mixing element is a different type of mixing element from the second mixing element;

wherein the first mixing element is a flow convergent and impingement mixer comprising two sidewalls, each of the two sidewalls including a plurality of tabs provided thereon;

wherein the second mixing element is a flapper mixer;

wherein the plurality of mixing elements further includes a third mixing element, wherein the third mixing element is a flapper mixer; and wherein the mixing system further comprises at least one attachment surface, wherein the attachment surface is configured to connect the first mixing element, the second mixing element, and the third mixing element with each other.

10. The mixing system of claim 9, wherein at least one attachment surface is shaped as a bar member.

11. The mixing system of claim 9, wherein the at least one attachment surface is formed by extending at least one of the two sidewalls of the first mixing element.

12. A mixing system, for an aftertreatment system, the mixing system comprising:

a mixing tube in fluid communication with an exhaust conduit;

a reductant injector positioned at an injection location on the mixing tube; and a mixer assembly positioned downstream of the injection location, the mixer assembly including a plurality of mixing elements provided in a series arrangement, such that each of the plurality of mixing elements is provided downstream of one another;

wherein each of the plurality of mixing elements is of a same type;

wherein the plurality of mixing elements includes a plurality of flapper mixers;

wherein at least one parameter of each of the plurality of flapper mixers is changed along an exhaust flow direction;

wherein the at least one parameter includes a fin density, a fin angle, an angle of attachment, a clocking of the flapper mixer about a longitudinal axis of the mixing tube, or a combination thereof; and wherein at least one of the fin density or the fin angle increases from one flapper mixer to another along an exhaust flow direction.

* * * * *